United States Patent [19]

Lieb et al.

[11] 4,083,067

[45] Apr. 11, 1978

[54] RECIRCULATING TOILET AND METHOD

[75] Inventors: Donald F. Lieb, Mentor; Neil W. Stillman, Madison; William E. Kidon, Chardon, all of Ohio

[73] Assignee: Diamond Shamrock Corporation, Cleveland, Ohio

[21] Appl. No.: 653,444

[22] Filed: Jan. 29, 1976

[51] Int. Cl.[2] ..... E03D 1/00; E03D 3/00; E03D 5/00

[52] U.S. Cl. ..... 4/317; 4/323; 210/104; 210/169

[58] Field of Search ..... 4/10, 89, 76, 90, 79, 4/91, 89, 75, 77; 210/104, 169

[56] References Cited

U.S. PATENT DOCUMENTS

| | | | |
|---|---|---|---|
| 2,858,939 | 11/1958 | Corliss | 210/136 |
| 2,951,251 | 9/1960 | Belden | 4/10 |
| 3,079,612 | 3/1963 | Corliss | 4/10 |
| 3,320,621 | 5/1967 | Vita | 4/10 |
| 3,579,646 | 5/1971 | Lekberg | 4/10 |
| 3,708,806 | 1/1973 | Kemper | 4/10 |
| 3,815,159 | 6/1974 | Delaney et al. | 4/10 |
| 3,824,632 | 7/1974 | Bach et al. | 4/12 |
| 3,834,536 | 9/1974 | Kelsey | 210/152 X |
| 3,856,642 | 12/1974 | Lieb et al. | 4/10 X |
| 3,873,445 | 3/1975 | Bussard | 4/10 |
| 3,922,730 | 12/1975 | Kemper | 4/77 X |
| 3,950,249 | 4/1976 | Eger et al. | 4/10 X |
| 3,958,279 | 5/1976 | Bogusz | 4/10 |

*Primary Examiner*—Henry K. Artis
*Attorney, Agent, or Firm*—John P. Hazzard

[57] ABSTRACT

A recirculating toilet having a bowl and a storage chamber, and recirculating means for recirculating liquid from the storage chamber through the bowl and back into the storage chamber. Filter means is interposed between the storage chamber and the recirculating means for filtering solid particles from liquid flowing from the storage chamber toward the recirculating means. A treatment chamber is interposed between the filter means and the recirculating means, and the treatment chamber has a volume substantially smaller than the storage chamber. Treatment means is provided for destroying bacteria in liquid contained in the treatment chamber (flush water).

21 Claims, 6 Drawing Figures

RECIRCULATING TOILET AND METHOD

BACKGROUND OF THE INVENTION

This invention relates to the art of sewage treatment and, more particularly, to treatment of sewage in a recirculating-type of toilet.

Toilets of the recirculating-type are commonly used on recreational vehicles and boats, and in other locations where a plentiful fresh water supply and sewage disposal facilities are lacking. These toilets include a storage chamber which is charged with a relatively small quantity of clear water and liquid from the storage chamber is recirculated through the bowl back into the storage chamber for flushing purposes. Human wastes desposited in the storage chamber mix with the initial water charge and form part of the flushing liquid.

Toilets of the type described commonly have a chemical added to the liquid in the storage chamber for destroying coliform and other bacteria in the liquid, and for reducing odor producing gases. In other arrangements, reagents are added to the storage chamber periodically or are generated electrolytically within the storage chamber from chemicals dissolved in the liquid in the storage chamber. Previous recirculating toilets of this type have included macerating means for macerating solids in an attempt to return same to a liquid form for recirculation through the bowl for flushing purposes.

Even though sewage solids are generally decomposable to a liquid, decomposition of the solids back to liquid form takes a relatively long time. Macerating the solids simply creates a large amount of suspended solids in the liquid contained in the storage chamber. These solids are fed back to the bowl for flushing purposes, and coliform or the like may not be completely destroyed by chemicals in the storage chamber because it requires time for the chemicals to attack the coliform contained within the solid particles. Solids containing live bacteria build up in the flush water to cause odors and create a health hazard.

The present invention sucessfully overcomes the above noted problems and others and provides a recirculating toilet which is simple, economical and readily adaptable to use in many environments.

SUMMARY OF THE INVENTION

A recirculating toilet of the type described includes filter means interposed between a storage chamber and a recirculating means for filtering solid particles from liquid flowing from the storage chamber to the recirculating means. This substantially eliminates solid particles from the flush water where they may cause odors and contain live coliform or other bacteria.

In a preferred arrangement, a treatment chamber is interposed between the filter means and the recirculating means, with the treatment chamber having a volume substantially smaller than the storage chamber. Treatment means is provided in the treatment chamber for destroying coliform in liquid contained in the treatment chamber. It has been found that treating a relatively small quantity of filtered liquid in the treatment chamber with a reagent for destroying coliform substantially eliminates live coliform from the treatment chamber, toilet bowl and storage chamber. The chemical used not only destroys coliform but also substantially reduces odors and destroys other bacteria.

In a preferred arrangement, the storage chamber includes a solids settling space positioned below the treatment chamber so that the solids are settled from liquid in the storage chamber before passage of liquid therefrom through the filter. The storage chamber has a discharge outlet communicating with the solids settling space so that back flushing of the treatment chamber and filter is provided when the storage chamber is discharged.

The filter means may comprise a substantially vertically positioned filter, and a solid weir is interposed between the filter and the storage chamber in outwardly-spaced relationship to the filter so that liquid from the storage chamber flows under the weir before flowing through the filter. It has been found that this arrangement substantially reduces clogging of the filter and induces a flow of liquid toward the solids settling space so that solids are kept from clogging the filter.

The treatment means in the treatment chamber preferably supplies a bacteria destroying chemical in an amount substantially exceeding the amount required for destroying all coliform in liquid contained within the treatment chamber. With this arrangement, an excessive amount of coliform destroying reagent is flushed through the bowl every time the toilet is used so that the excessive reagent treats bacteria and odor producing compounds within the storage chamber itself.

The toilet preferably includes filter and pump chambers located on opposite sides of the treatment chamber. The filter and pump chambers have a volume substantially larger than the volume of the treatment chamber so that the relatively small quantity of liquid in the treatment chamber can be treated with a very high concentration of chemical or reagent.

The recirculating toilet of the present invention has sequentially connected storage, filter, treatment and pump chambers. A filter is interposed between the storage chamber and filter chamber for filtering liquid passing from the storage chamber to the filter chamber and the storage chamber has a bottom spaced substantially below the filter to define a solids settling space.

All of the filter, treatment and pump chambers preferably have bottoms spaced above the bottom of the storage chamber so that the solids settling space in the storage chamber underlies the bottoms of the filter, treatment and pump chambers.

The filter, treatment and pump chambers are connected in liquid-flow communication by flow inhibiting means for inhibiting mixing of liquid in the treatment chamber with liquid in the filter and pump chambers when the liquid level in the chambers is substantially the same. An atmospheric vent preferably communicates with the treatment chamber for exhausting gases formed therein during formation or release of the coliform destroying reagent.

In one arrangement, the treatment means in the treatment chamber includes electrodes positioned therein for electrolytically generating bacteria destroying reagent from the chemical dissolved in the liquid in the toilet.

In accordance with another arrangement, the treatment means may include dispensing means for dispensing a bacteria destroying reagent into the treatment chamber.

It is a principal object of the present invention to provide an improved recirculating-type of toilet wherein substantially all of the bacteria and noxious gases are eliminated from the flush water.

It is an additional object of the invention to provide an improved recirculating toilet wherein solids are substantially eliminated from passage through the toilet bowl for flushing purposes.

It is a further object of the invention to provide a recirculating toilet wherein clogging of a filter is minimized by locating an underflow weir between the filter and a storage chamber.

It is also an object of the present invention to provide an improved recirculating-type of toilet wherein a relatively small quantity of liquid in the toilet is treated with a coliform destroying reagent before the liquid is used for flushing purposes.

It is another object of the invention to provide an improved recirculating toilet wherein a relatively small quantity of liquid is treated with coliform destroying reagent in an amount substantially exceeding that required to destroy all coliform in the relatively small quantity of liquid.

It is an additional object of the invention to provide an improved method of treating liquid in a recirculating-type of toilet.

BRIEF DESCRIPTION OF THE DRAWINGS

The invention may take form in certain parts and arrangements of parts, a preferred embodiment of which will be described in detail in the specification and illustrated in the accompanying drawings which form a part hereof and wherein.

DESCRIPTION OF THE PREFERRED EMBODIMENTS OF THE INVENTION

Figure 1:
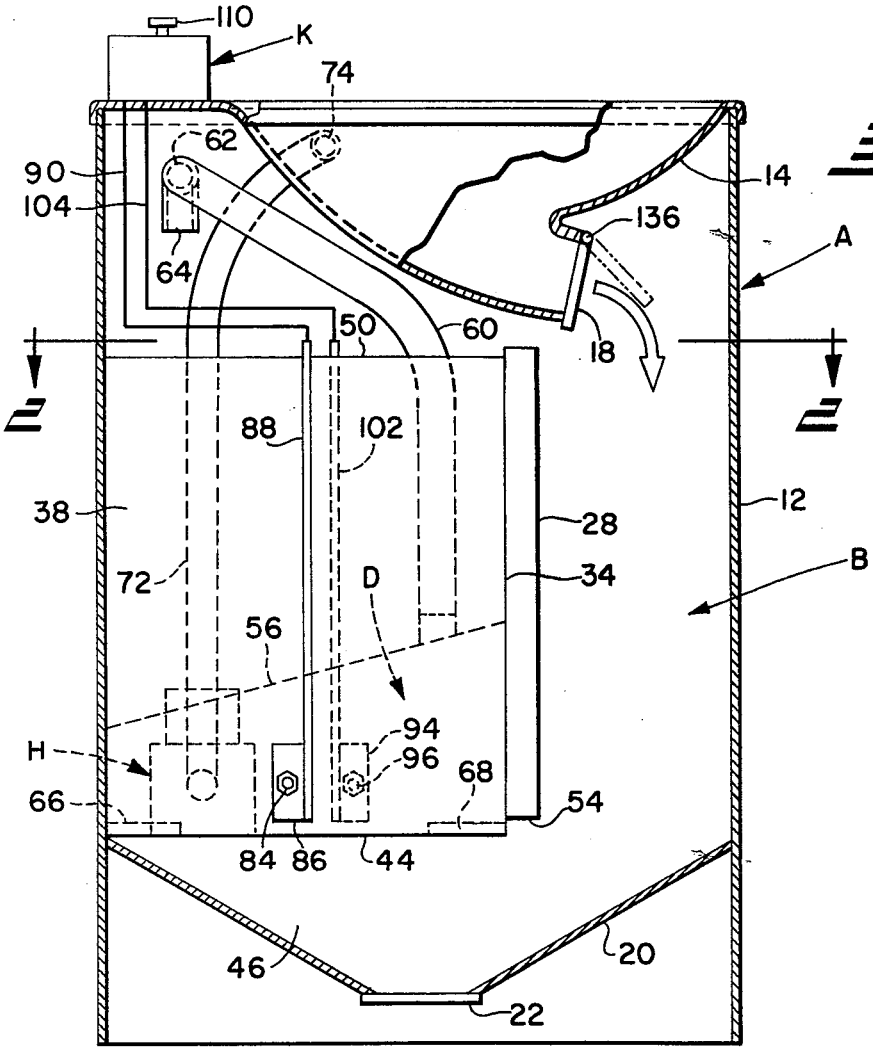
FIG. 1 is a side elevational view of a toilet constructed in accordance with the present invention, and with the sidewall of the toilet cut-away for clarity of illustration.

With reference to the drawing, FIG. 1 shows a toilet A including a hollow housing 12 having a bowl 14 suitably mounted on the upper end thereof for receiving human waste material. Bowl 14 has an outlet which discharges through an outlet valve 18 to a storage chamber B having a downwardly sloping bottom wall 20 with a valved discharge outlet 22. Obviously, a seat and cover are normally hinged to the top of toilet A above bowl 14 in a conventional manner.

Figure 2:
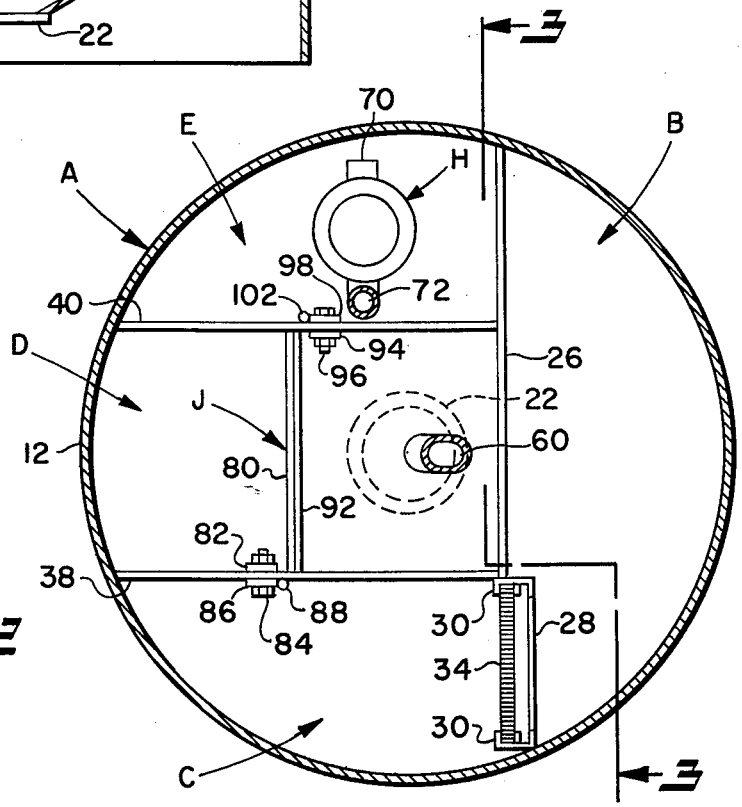
FIG. 2 is a cross-sectional plan view taken generally on line 2—2 of FIG. 1.

As best shown in FIG. 2, a generally vertical partition wall 26 extends across housing 12 of toilet A, and includes an outwardly displaced partition portion 28 defining a weir. Suitable vertical grooves as at 30 slidably receive the opposite vertical edges of generally vertically positioned filter 34 which may take many forms, including an accordion-like pleated and slotted plastic filter element.

Spaced-apart partition walls 38 and 40 extend from housing 12 generally perpendicular to partition wall 26 to define a filter chamber C, a treatment chamber D and a pump chamber E. A bottom wall 44 extends completely across the bottoms of chambers C, D and E from partition wall 26 and filter 34 to housing 12 at the rear of toilet A. This leaves a solids settling space shown generally at 46 in FIG. 1 spaced substantially below bottom wall 44 so that the solids settling space underlies the bottoms of chambers C, D and E.

Figure 3:
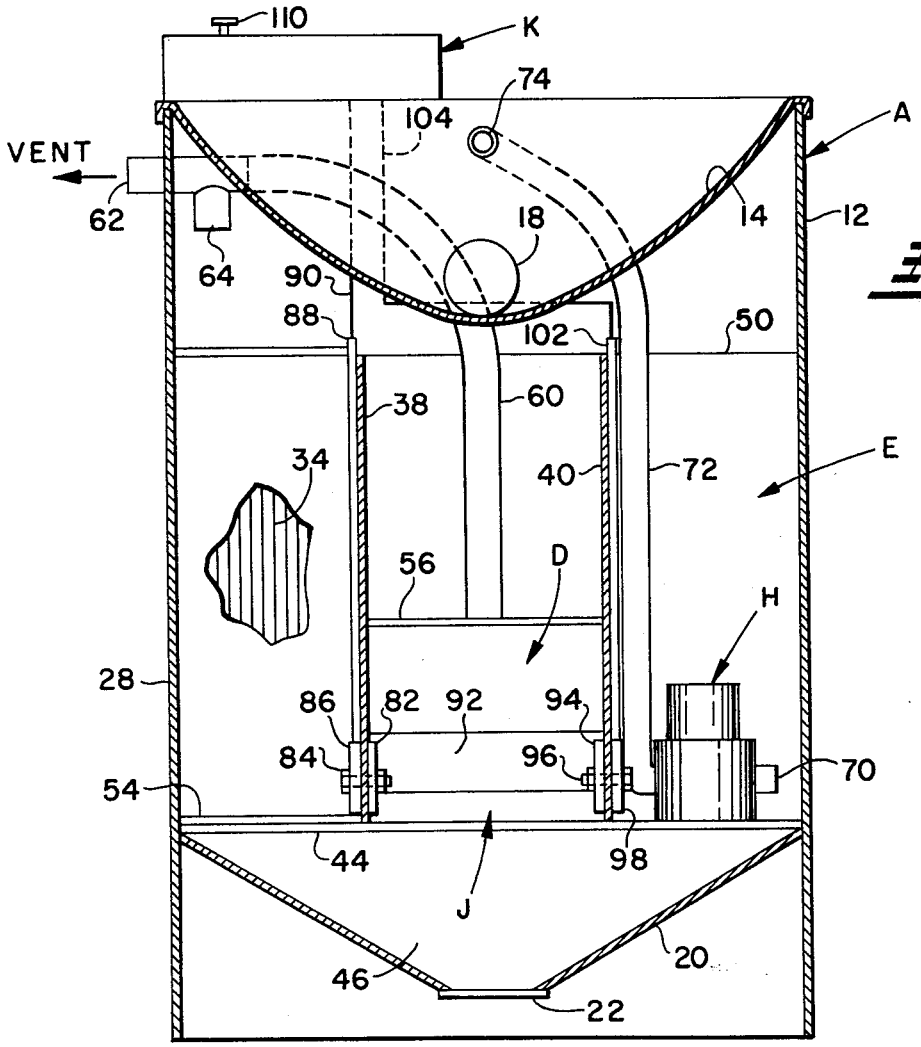
FIG. 3 is a cross-sectional elevational view taken generally on line 3—3 of FIG. 2.

Partition wall 26, weir 28, filter 34, partition wall 38 and partition wall 40 all have substantially coincidental top edges lying in a substantially common horizontal plane and are indicated by a common numeral 50 in FIGS. 1 and 3.

Weir has a bottom edge 54 located closely adjacent bottom 44 as shown in FIGS. 1 and 3 so that liquid must flow beneath bottom weir edge 54 from storage chamber B before flowing through filter 34 to filter chamber C. It has been found that this arrangement substantially minimizes clogging of filter 34 by solid particles suspended within liquid in storage chamber B.

As shown in FIGS. 1, 2 and 3, treatment chamber D has a volume which is substantially less than storage chamber B, and substantially less than filter chamber C and pump chamber E. A treatment chamber top wall 56 is inclined upwardly from the rear of toilet A between partition walls 38 and 40 toward partition wall 26, and intersects partition wall 26 along an intersecting line located more than one-half the distance from top edges 50 toward bottom wall 44. Filter chamber C and pump chamber E both have a volume substantially less than the volume of storage chamber B, and treatment chamber D has a volume substantially less than filter chamber C and pump chamber E. A vent conduit 60 is connected through treatment chamber top wall 56 adjacent partition 26 and exits to atmosphere through a vent opening 62. An additional vent conduit 64 connects with conduit 60 for venting the other chambers through vent opening 62.

As best shown in FIG. 1, a relatively small opening 66 is formed through partition wall 38 adjacent the rear of toilet A and adjacent bottom wall 44 for establishing communication between filter chamber C and treatment chamber D. Another relatively small opening 68 is formed through partition wall 40 adjacent partition wall 26 and bottom wall 44 for establishing communication between treatment chamber D and pump chamber E. In effect, openings 66 and 68 define flow inhibiting means for inhibiting mixing of liquid in treatment chamber D with liquid in either of chambers C and E when all of such chambers are at substantially the same level. However, such openings or flow inhibiting means provide free communication between the chambers for refilling the respective chambers when liquid is circulated from pump chamber E through bowl 14 back into storage chamber B. Obviously, baffles or the like could also be provided for inhibiting mixing of the liquid in treatment chamber D with the liquid in the adjacent chambers while the liquid in the treatment chamber is undergoing treatment.

A motor pump unit H positioned in the bottom of pump chamber E has an inlet 70 and an outlet discharging through conduit 72 to bowl flush opening 74. When motor pump unit H is operated, liquid swirls around bowl 14 from bowl flush opening 74 and flows past bowl outlet valve 18 back to storage chamber B. Bowl outlet valve 18 may be operated to an open position by a solenoid or the like when motor pump unit H is energized, or may be opened by liquid flowing into bowl 14 through bowl flush opening 74. Obviously, valve 18 may also be opened by a flush handle which simultaneously energizes motor pump unit H.

As best shown in FIGS. 1, 2 and 3, an electrode assembly J is positioned within treatment chamber D for producing electrolytic action therein. Electrode assembly includes an electrode 80 having a mounting plate 82 positioned within treatment chamber D against partition wall 38 and secured thereto by a bolt and nut assembly 84 passing through an outer plate 86. A rod 88 is connected with plate 86 and with control box K by wire 90 in FIG. 1. Another electrode 92 (of opposite polarity) extending across treatment chamber D in parallel spaced-apart relationship to electrode 80 has a mounting plate portion 94 secured by a bolt and nut assembly 96 to a plate 98 having a rod 102 connected by a wire 104 with control box K of FIG. 1. Obviously, suitable seals or gaskets may be provided around the openings in partition walls 38 and 40 through which bolt and nut assemblies 84 and 96 pass.

The electrode which is anodic is preferably a dimensionally stable anode, typically titanium or a similar metal covered with an electrically conductive, electrocatalytically active coating, such as a platinum group metal, platinum group metal oxide, or other coating known to the art to be effective and long-lived in a chlorine discharge environment. The base metal itself may be either a continuous or a foraminous sheet. The electrode which is the cathode need not be coated, a bare titanium surface, for example, comprises an effective cathode. Other electrolytically active but chemically and mechanically inert metals may be employed. It should be understood that while the electrode assembly shown is monopolar, with a greater number of electrodes, it is possible and often preferred, because of the increased power utilization efficiency possible, to establish bipolar operation wherein opposed sides of the same electrode serve as anode and cathode between terminal electrodes of opposite charge. As such bipolar electrodes are well known in the art they will not be discussed in detail.

Figure 6:
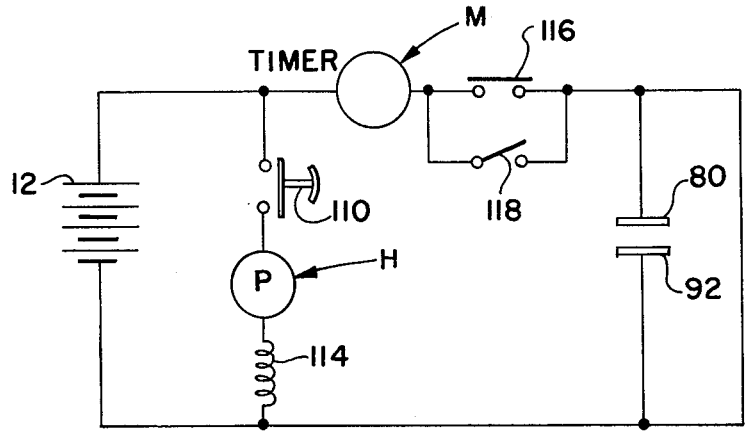
FIG. 6 is a schematic illustration of a control circuit which can be used with the improved toilet of the present invention.

Control box K may include a push button operated switch generally indicated at 110 for operating motor pump unit H and electrodes 80 and 92. Obviously, the control arrangement may take many forms. One arrangement is schematically illustrated in FIG. 6 wherein a voltage source 112 is connected for operating motor pump unit H upon closing of push button switch 110. Closing of switch 110 also energizes a relay 114 having a normally open contact 116 which is closed upon energization of relay 114 to start a timer M having a holding contact 118 for maintaining same energized after push button switch 110 has been opened and relay 114 de-energized. As long as timer M runs, electrodes 80 and 92 are connected with voltage source 112 for producing electrolytic action within liquid contained within treatment chamber D. Once timer M has timed out, its holding contact 118 opens for de-energizing the electrodes. In certain arrangements, it is possible to maintain electrodes 80 and 92 energized constantly upon closing a main on-off switch when it is expected that the toilet will be used rather frequently over a relatively short period of time.

In operation of toilet A, storage chamber B is filled with a predetermined quantity of water and a suitable chemical, including sodium chloride or other alkaline metal halides or the like, which will produce a bacteria destroying reagent under electrolysis. When toilet A is used, switch 110 is closed for flushing bowl 14 by operation of motor pump unit H. This also energizes relay 114 to close normally open relay contacts 116 and start the motor of timer M. Once the motor of timer M starts, its own holding contact 118 is closed to establish a holding circuit around normally open contacts 116 for maintaining electrodes 80 and 92 energized for a predetermined period of time. Electrodes 80 and 92 create electrolytic action in the liquid contained within treatment chamber D for producing a bacteria destroying reagent from the chemical dissolved in the liquid in toilet A. Where the chemical is sodium chloride, the action of electrodes 80 and 92 will produce sodium hypochlorite. Obviously, other chemicals may be dissolved in the liquid for electrolytically generating other reagents which will destroy coliform and other bacteria, and aid in reducing odors. Any gases produced by the electrolysis are vented to atmosphere through vent conduit 60 and vent conduit opening 62. Electrodes 80 and 92 are preferably energized for a sufficient period of time to produce bacteria destroying reagent substantially exceeding the amount required for destroying all coliform in the liquid contained within treatment chamber D. This will insure a constant supply of liquid to pump chamber E having a zero coliform count, and excess of reagent for cleansing bowl 14 and mixing back with the liquid in storage chamber B for destroying coliform and reducing odors therein.

When motor pump unit H is energized, liquid is drawn from pump chamber E for flushing bowl 14 and the liquid flows back to storage chamber B through bowl outlet valve 18. Liquid then flows from treatment chamber D through opening 68 of FIG. 1 to pump chamber E. Liquid also flows from filter chamber C through opening 66 in partition wall 38 to treatment chamber D. Liquid flows from storage chamber B through filter 34 beneath bottom edge 54 of weir 28 into filter chamber C. This arrangement provides substantially settling of solids settling space 46 to minimize clogging of filter 34 and circulation of solids back through bowl 14. In addition, the substantial absence of suspended solids in the liquid used for flushing bowl 14 minimizes any buildup of coliform in the flush water. This not only substantially reduces odors but also provides a relatively germ-free unit.

Figure 4:
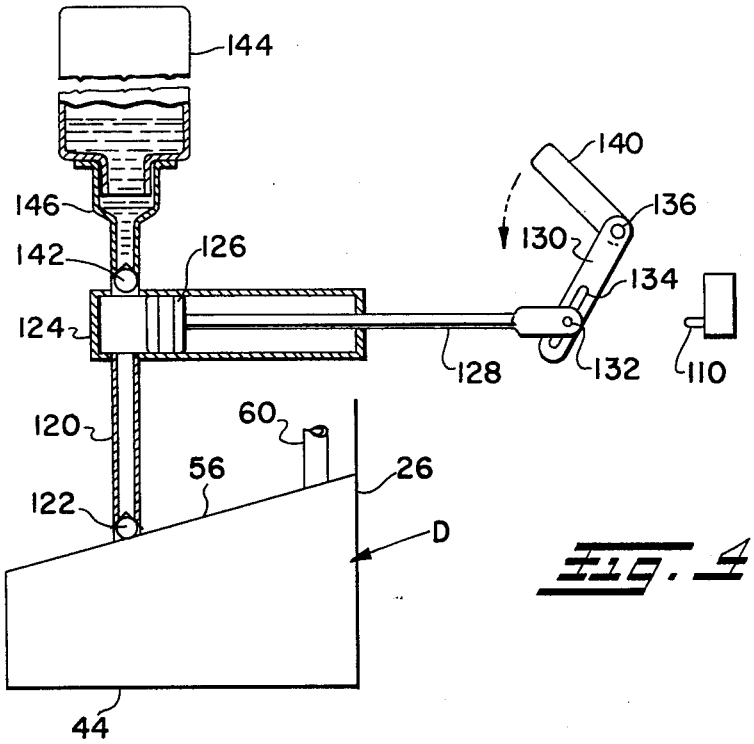
FIG. 4 is a schematic elevational view showing an arrangement for injecting coliform destroying means into a treatment chamber.

Although electrolysis is the preferred arrangement for producing bacteria destroying reagent, it will be recognized that bacteria destroying reagent may be introduced into treatment chamber D in other forms. For example, FIG. 4 shows an arrangement wherein a conduit 120 communicates with treatment chamber D past a ball check valve 122 through treatment chamber top wall 56. Conduit 120 communicates with cylinder 124 having a piston 126 attached to a rod 128 connected with lever 130 by a pin 132 received in an elongated slot 134 in lever 130 for accommodating linear movement of rod 128 upon swinging movement of lever 130. Lever 130 is mounted to a rod 136 connected to bowl outlet valve 18 in FIG. 1. A flush handle 140 attached to rod 136 is pushed down counterclockwise for swinging lever 130 and moving piston 126 to the right in FIG. 4 in a suction stroke for sucking liquid into cylinder 124 past ball check valve 142 from a reservoir 144 of a chlorine liberating reagent, or other coliform destroying material, positioned in a receiver 146. A torsion spring may be positioned to the right of piston 126 in cylinder 124 for normally biasing piston 126 to the left in FIG. 4. When the toilet is flushed, pushing on flush lever 140 causes lever 132 to operate switch 110 for energizing motor pump unit H. When flush handle 140 is released, the spring biases same clockwise and also moves piston 126 to the left in FIG. 4 for forcing liquid from cylinder 124 through conduit 120 and past ball check valve 122 into treatment chamber D. Conduit 120 may be of relatively small diameter for holding a very small quantity of liquid so that very little charging is required before operation of piston 126 will cause introduction of a substantial charge of reagenet into treatment chamber D. Receiver 146 may be mounted on the outside of housing 12 of toilet A for receiving container 144 through which the treating reagent would be visible so that a user of a toilet could tell when a new supply of reagent was required. The reagent within container 144 could simply be chlorine in the form of hypochlorite. Obviously, a reagent container could be positioned within housing 12 between partition walls 38 and 40 above treatment chamber top wall 56, and a fill opening could extend outwardly of the side wall of housing 12 or could open upwardly outwardly of bowl 14. A liquid level indicator for the reagent could be provided exteriorly of housing 12.

Figure 5:
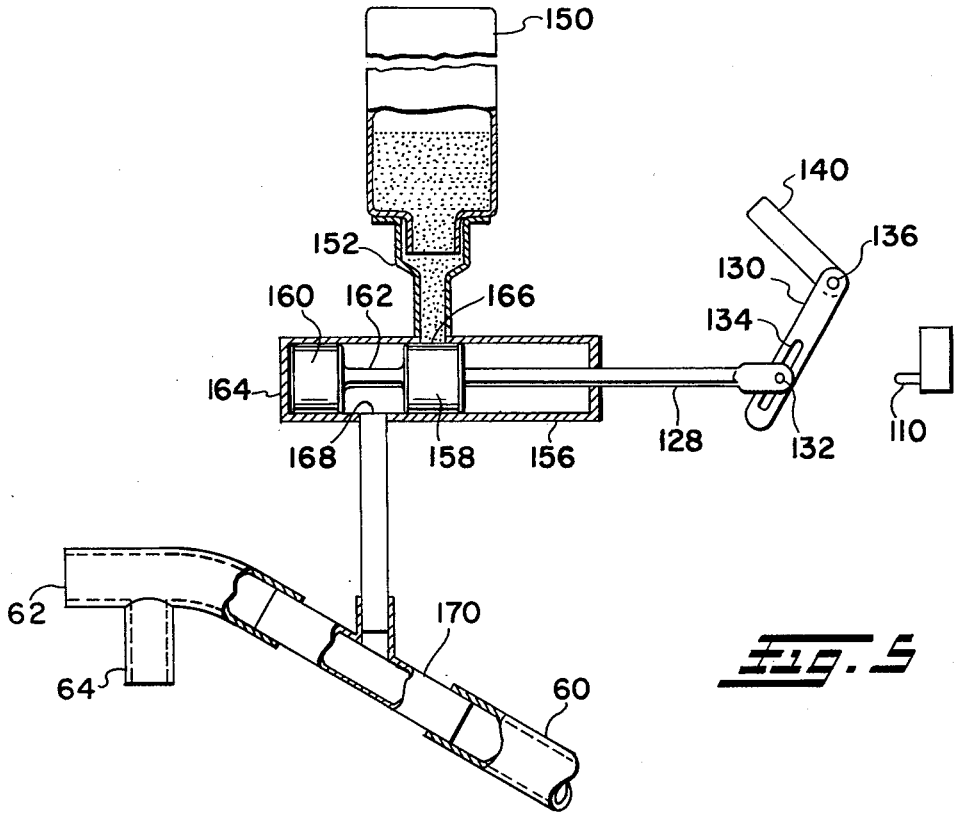
FIG. 5 shows still another arrangement for injecting coliform destroying reagent into a treatment chamber.

Instead of using a liquid hypochlorite or other reagent, it is possible to use a reagent in granular or powdered form. For example, hypochlorite in a soluble carrier may be contained in a receptacle 150 as shown in FIG. 5 and mounted in a receiver 152. A cylinder 156 having a double piston arrangement as at 158 and 160 connected by a rod 162 is provided in cylinder 164 having a inlet 166 from receiver 162, and an outlet 168 to a Y-connector 170 in vent conduit 60. When flush handle 140 is depressed in FIG. 5 for flushing the toilet, pistons 158 and 160 move to the right so that inlet 166 is open while outlet 168 is closed by piston 160. This fills the space between the pistons with granular reagent. Upon releasing flush handle 140, a torsion spring, or a coil spring positioned within cylinder 164, moves pistons 158 and 160 to the left in FIG. 5 to the positions shown for opening outlet 168 so that the treating reagent contained between the pistons flows into vent conduit 60 and falls into treatment chamber D where it dissolves for destroying coliform and other bacteria, as well as reducing odor producing gases.

In the arrangements of FIGS. 4 and 5, sufficient reagent is supplied to treatment chamber D for destroying all coliform in the liquid contained in the treatment chamber, and providing an excess of such reagent for flushing through bowl 14 and further treating coliform and noxious gases within storage chamber B. Obviously, many different arrangements may be provided for injecting or dispensing reagents into treatment chamber D and the examples given in FIGS. 4 and 5 are simply illustrative. It is also possible to provide an access opening in the rear of housing 12 of toilet A so that a removable cover or plus in treatment chamber top wall 56 can be removed. A solid bar of reagent dispersed throughout a water soluble medium can then be suspended in a mesh basket or the like within treatment chamber D so it dissolves and continuously supplies coliform destroying reagent to the liquid in the treatment chamber.

The entire top of toilet A including bowl 14 may be removably attached to housing 12 by snap fasteners or screws for providing access to the interior of the toilet for cleaning or replacing filter 34, and making other repairs. The conduits and wires may have sufficient slack to allow lifting of the top to a position where the wires and conduits can be disconnected for complete removal of the top.

Instead of manually operating the dispensing arrangements of FIGS. 4 and 5, it is possible to connect a solenoid with the piston rods, and wire the solenoid in series with pump H and relay 114 of FIG. 6.

Substantially entire toilet A may be constructed of synthetic plastic material, with the various partitions and walls adhesively secured together. It is also possible to provide channel-like grooves in certain walls or partitions for receiving edges of mating walls or partitions. In an arrangement of this type, the walls and partitions could removably slide together with gaskets interposed between the grooves and the edges of adjacent panels received therein. An access opening may be provided in the rear of housing 12, and treatment chamber top wall 56 may be removable, to provide access to the electrodes.

In a toilet constructed in accordance with the present invention, it has been found by test that essentially a zero coliform count is maintained in the liquid contained in the treatment and storage chambers, and odor is substantially eliminated. The flushing liquid is clarified and purified before it is circulated through the bowl by a combination of filter action and chemical action. Instead of storage chamber B having a bottom generally in the form of an inverted truncated cone as shown, it is obvious that it could slope from front-to-rear or vice versa, or from side-to-side. A pump out connection could also be connected with a discharge outlet located adjacent the bottom of the solids settling space. When the storage chamber is discharged, the filter and the other chambers are backflushed by sequential flow between the pump, treatment, filter and storage chambers.

Test data for a toilet constructed in accordance with the subject invention is presented below. The apparatus used in obtaining this data was of the general type shown in FIG. 1. The bacteriocidal action was accomplished by electrolyzing an aqueous solution of sodium chloride. Each flush cycle provided about 2 gallons of waste water. The electrolysis was conducted at a current density of about 1 to 1.5 amps per square inch for a period of about 2 minutes. This table shows the effectiveness of the apparatus of the invention when used over a six day period for a total of 113 uses, with the urination to defecation use ratio being 3.7

Table

| Day | Uses (Cumulative) | Test Time | Coliform in Flush Water (count/100 ml) |
|---|---|---|---|
| 1 | 29 | 8:15 | 0 |
| | | 10:45 | 0 |
| | | 1:30 | 0 |
| | | 3:30 | 0 |
| 2 | 41 | 8:25 | 0 |
| | | 10:50 | 0 |
| | | 1:40 | 0 |
| | | 3:45 | 0 |
| 3 | 58 | 8:25 | 0 |
| | | 10:25 | 0 |
| | | 1:10 | 0 |
| | | 3:20 | 0 |
| 4 | 76 | 8:10 | 0 |
| | | 10:55 | 0 |
| | | 1:15 | 0 |
| | | 3:20 | 0 |
| 5 | 103 | 8:20 | 0 |
| | | 10:45 | 0 |
| | | 1:05 | 0 |
| | | 3:15 | 0 |
| 6 | 113 | 8:20 | 0 |
| | | 11:55 | 0 |
| | | 1:45 | 0 |
| | | 3:20 | 0 |

From the foregoing table, it may be seen that random sampling shows that all of the coliform bacteria are destroyed.

Although the invention has been shown and described with respect to preferred embodiments, it is obvious that equivalent alterations and modifications will occur to others skilled in the art upon the reading and understanding of this specification. The present invention includes all such equivalent alterations and modifications, and is limited only by the scope of the claims.

Having thus described my invention, I claim:

1. A recirculating toilet system wherein the recirculating flush liquid includes treated liquid waste comprising a toilet bowl having a discharge means;

a waste storage chamber operatively connected to said toilet bowl discharge means;

a valved discharge outlet on said waste storage chamber for periodically discharging the accumulated solid and liquid waste content from the toilet system;

a flush liquid treatment chamber in liquid communication with said waste storage chamber;

filter means interposed between said flush liquid treatment chamber and said waste storage chamber; said filter means being located above said valved discharge outlet and the maximum level of settled accumulated solid waste in said waste storage chamber and being located at least partially below the flush liquid level in said flush liquid treatment chamber so as to provide said liquid communication between said waste storage chamber and said flush liquid treatment chamber;

means associated with said flush liquid treatment chamber for destroying bacteria in said flush liquid in said flush liquid treatment chamber;

and means for circulating said treated flush liquid from said flush liquid treatment chamber to said toilet bowl on activation of a control by the user of said recirculating toilet system.

2. The recirculating toilet system of claim 1 wherein said flush liquid treatment chamber is within the waste storage chamber and is positioned at least partially below the liquid level of said waste storage chamber so that recirculating flush liquid flows by gravity from the waste storage chamber, through the filter means into said flush liquid treatment chamber.

3. The recirculating toilet system of claim 2 wherein said filter means comprises a filter positioned below the liquid level of said waste storage chamber and above the level of any settled solids in said waste storage chamber so that liquid flow to said filter is substantially vertically upward.

4. The recirculating toilet system of claim 1 wherein said means for destroying bacteria supplies a bactericide to liquid in said flush liquid treatment chamber in an amount substantially exceeding the amount required to destroy all coliform present in the liquid in said flush liquid treatment chamber.

5. The recirculating toilet system of claim 1 wherein said means for destroying bacteria includes electrodes positioned in said treatment chamber for electrolytically generating coliform destroying reagent from chemical dissolved in liquid in said toilet.

6. The recirculating toilet system of claim 5 wherein liquid in said toilet has sodium chloride dissolved therein and said electrodes generate sodium hypochlorite.

7. The recirculating toilet system of claim 1 wherein said means for destroying bacteria includes dispensing means for dispensing a coliform destroying reagent into said treatment chamber.

8. A recirculating toilet system comprising a toilet bowl having a discharge means;

a waste storage chamber for receiving waste deposited in said toilet bowl by gravity flow upon flushing of said recirculating toilet system; said waste storage chamber having flush liquid partially filling same;

a flush liquid treatment chamber in liquid communication with said waste storage chamber;

said flush liquid treatment chamber being positioned at least partially below the liquid level of the flush liquid so that flush liquid can flow by gravity from said waste storage chamber into said flush liquid treatment chamber;

a filter interposed between said flush liquid treatment chamber and said waste storage chamber so as to filter all flush liquid passing from said waste storage chamber to said flush liquid treatment chamber, said filter being positioned at least partially below the liquid level and above the level of any settled solids in said waste storage chamber;

means interposed between any incoming waste and said filter to prevent settling solids from coming in direct contact with said filter;

treatment means associated with said flush liquid treatment chamber for destroying any bacteria in said flush liquid in said flush liquid treatment chamber;

pumping means for circulating said treated flush liquid from said flush liquid treatment chamber to said toilet bowl on activation of a control by the user of said recirculating toilet system; and a valved discharge outlet substantially at the bottom of said waste storage chamber which serves to periodically discharge the accumulated waste content from the toilet system and effect a backwashing of the filter by gravity draining of flush liquid in the flush liquid treatment chamber back into the waste storage chamber during such discharge.

9. The recirculating toilet system of claim 8 wherein said treatment means for destroying bacteria in the flush liquid supplies a bactericide in an amount substantially exceeding the amount required to destroy all coliform present in the liquid in said flush liquid treatment chamber.

10. The recirculating toilet system of claim 8 wherein said treatment means for destroying bacteria includes electrodes positioned in said flush liquid treatment chamber for electrolytically generating coliform destroying reagent from chemicals dissolved in said flush liquid in said system.

11. The recirculating toilet system of claim 8 wherein said circulating flush liquid has sodium chloride dissolved therein and said electrodes generate sodium hypochlorite.

12. The recirculating toilet of claim 8 wherein said treatment means for destroying bacteria includes dispensing means for dispensing a coliform destroying reagent into said flush liquid treatment chamber.

13. A recirculating toilet system comprising a toilet bowl having a discharge means;

a waste storage chamber for receiving waste deposited in said toilet bowl by gravity flow upon flushing of said recirculating toilet system, said waste storage chamber having flush liquid partially filling same;

a filter chamber at least partially below the liquid level in the waste storage chamber and in liquid communication therewith;

a filter at the inlet to said filter chamber; said inlet being vertically positioned at least partially below the liquid level in the waste storage chamber and above the level of any settled solids in said waste storage chamber;

a flush liquid treatment chamber in liquid communication via an aperture with said filter chamber; said aperture and flush liquid treatment chamber being at least partially below the liquid level in the waste storage chamber;

treatment means associated with said flush liquid treatment chamber for destroying any bacteria in said flush liquid in said flush liquid treatment chamber;

a pump chamber in liquid communication via an aperture with said flush liquid treatment chamber;

pumping means associated with said pump chamber for circulating said treated flush liquid from said pump chamber to said toilet bowl on activation of a control by the user of said recirculating toilet system; and a valved discharge outlet substantially at the bottom of said waste storage chamber which serves to periodically discharge the accumulated waste content from the toilet system and simultaneously effect a backwashing of the filter by gravity draining of filtered and treated flush liquid back into the waste storage chamber during such discharge.

14. The recirculating toilet system of claim 13 wherein said treatment means for destroying bacteria in the flush liquid supplies a bactericide in an amount substantially exceeding the amount required to destroy all coliform present in the liquid in said flush liquid treatment chamber.

15. The recirculating toilet system of claim 13 wherein said treatment means for destroying bacteria includes electrodes positioned in said flush liquid treatment chamber for electrolytically generating coliform destroying reagent from chemicals dissolved in said flush liquid in said system.

16. The recirculating toilet system of claim 13 wherein said circulating flush liquid has sodium chloride dissolved therein and said electrodes generate sodium hypochlorite.

17. The recirculating toilet of claim 13 wherein said treatment means for destroying bacteria includes dispensing means for dispensing a coliform destroying reagent into said flush liquid treatment chamber.

18. The recirculating toilet system of claim 13 wherein a baffle means is interposed between any incoming waste and said filter to prevent settling solids from coming in direct contact with said filter.

19. The recirculating toilet system of claim 18 wherein said baffle means is an underflow weir which extends above the level of liquid in the waste storage chamber and below the inlet to said filter chamber so as to require all entering waste and flush liquid to flow under said weir before reaching said filter.

20. The recirculating toilet system of claim 13 wherein said filter, flush liquid treatment, and pump chambers are connected in liquid flow communication by flow inhibiting apertures spaced substantially apart to inhibit mixing of liquids among said chambers when the liquid levels are substantially the same in each such chamber.

21. The recirculating toilet system of claim 13 wherein the filter chamber and the pumping chamber are substantially larger than the flush liquid treatment chamber.

* * * * *